US005642981A

United States Patent [19]

Kato et al.

[11] Patent Number: 5,642,981

[45] Date of Patent: Jul. 1, 1997

[54] REGENERATIVE PUMP

[75] Inventors: Eisuke Kato; Takashi Nagai, both of Oobu, Japan

[73] Assignee: Aisan Kogyo Kabushiki Kaisha, Aichi, Japan

[21] Appl. No.: 697,289

[22] Filed: Aug. 26, 1996

Related U.S. Application Data

[63] Continuation of Ser. No. 506,774, Jul. 26, 1996, abandoned.

[30] Foreign Application Priority Data

Aug. 1, 1994 [JP] Japan ..... 6-180318

[51] Int. Cl.[6] ..... F04D 17/06

[52] U.S. Cl. ..... 415/55.1

[58] Field of Search ..... 415/55.1, 55.5

[56] References Cited

U.S. PATENT DOCUMENTS 5,265,996 11/1993 Westoff et al. ..... 415/55.1

5,407,318 4/1995 Ito et al. ..... 415/55.1

FOREIGN PATENT DOCUMENTS

| | | | |
|---|---|---|---|
| 57-5594 | 1/1982 | Japan | 415/55.1 X |
| 57-81191 | 5/1982 | Japan | 415/55.1 |
| 57-97097 | 6/1982 | Japan | 415/55.1 |
| 57-99298 | 6/1982 | Japan | 415/55.1 |
| 2 218 748 | 11/1989 | United Kingdom | 415/55.1 |

*Primary Examiner*—John T. Kwon

*Attorney, Agent, or Firm*—Koda and Androlia

[57] ABSTRACT

A regenerative pump having a plurality of concave channels and blades provided along a peripheral edge of an impeller in a substantially radial direction. A forward surface of the blades in the direction of the impeller is formed concave and a forward surface of the blade in a radially outer portion of the impeller is positioned in a rear position in the direction of rotation relative to the forward surface of the blade in a radially inner portion of the blade.

1 Claim, 12 Drawing Sheets

REGENERATIVE PUMP

This is a continuation of application Serial No. 08/506, 774, filed Jul. 26, 1996 now abandoned.

BACKGROUND OF THE INVENTION

1. Field of the Invention

The present invention relates to an improvement to a regenerative pump used as a vehicle fuel pump, etc., and particularly to a pump of wich pump efficiency is improved by increasing a delivery pressure without decreasing a flow rate compared to a conventional pump.

2. Description of the Prior Art

Non-contact type pumps and non-positive displacement pumps are known as examples of regenerative pumps. The regenerative pump is provided with an impeller, and the impeller comprises a flat disc-shaped base plate, a plurality of concave channels formed along peripheral edges on both sides of the base plate, and blades positioned between the concave channels so as to extend in a radial direction of the base plate. The impeller is housed in a pump chamber formed in a housing. The impeller is supported in the pump chamber by a shaft passing through the center of the base plate and is rotated within the plane vertical to the shaft. Liquid flowing through an inlet port formed in the housing is delivered at high pressure from an outlet port formed in the housing.

For a generally known conventional regenerative pump, as shown assigned with reference symbol P01 in FIGS. 16 and 17, an impeller 3 which is housed and rotated in a pump chamber of a housing 1, is formed in a flat disc-shaped base plate. Along the peripheral edges on both sides of the base plate, a plurality of concave channels 5 are formed at even intervals in the peripheral direction of the base plate and further formed in such a way as to be gradually deeper from the radially innermost ends to the radially outer most ends thereof. Blades 4 having a constant thickness in the peripheral direction are formed so as to extend in the radial direction of the base plate. The pump chamber accommodating the impeller 3 is provided with flat inner side walls 6 opposite to flat surfaces of the base plate, cylindrical inner peripheral wall 7 opposite to the peripheral tip ends of the blades 4 formed along the outer circumferential edge of the base plate, and arcing grooved wall surfaces 8 opposite to the side surfaces of the blades 4 for connecting the flat inner side walls 6 to the cylindrical inner peripheral wall 7 as well as forming a fluid passage 2 connecting the inlet port to the outlet port (neither of which is shown), both being formed in the housing 1.

In this conventional type of regenerative pump P01, liquid flow LM arising from friction between the blades 4 and liquid is generated in the fluid passage 2 in the direction of the rotation of the impeller 3 designated by allow F, as a result of the rotation of the impeller 3. Further, liquid flow LB is generated in the radial direction of the impeller 3 along surfaces 9 of the blades 4 which forwardly face in the direction F of the rotation of the impeller 3. This flow LB merges with the flow LM within the fluid passage 2. As a result of this, a decrease in the flow velocity of the liquid flow LM that are introduced from the inlet port and flow through the fluid passage 2 results in the conversion of velocity energy into pressure energy, whereby the liquid are delivered from the discharging opening at a high pressure.

Japanese Unexamined Patent Application Gazette No. Hei 2-45690 published in 1990 discloses an improved regenerative pump shown in FIGS. 18 and 19. For this pump P02, as is evident from FIG. 18, the thickness in the peripheral direction of each blade 4 of the impeller 3 gradually increases as the radius of the impeller 3 decreases. The edge of each concave channel 5 closer to the center of the rotation of the impeller 3 assumes a contour which joins two arc surfaces **4*a* and 4*b***.

This pump P02 is the same as the pump P01 in that the center of the thickness in the peripheral direction of each blade 4 is positioned in one radial line passing through the center of the rotation of the impeller 3. However, compared to the pump P01, the pump P02 can produce an increased pump delivery pressure because the liquid flow LB developed in the concave channels 5 flows smoothly by virtue of the existence of the arc surfaces **4*a* and 4*b*. However, if the radial length of the blades 4 is the same as the length of the blades 4 of the pump P01, the volume of the concave grooves 5** will be reduced, which causes a flow rate of the pump to be reduced, Hence, no improved pump efficiency is attained.

SUMMARY OF THE INVENTION

The primary object of the present invention is to provide a regenerative pump whose pump efficiency is improved by increasing a delivery pressure without decreasing a flow rate.

Other objects and advantages of the present invention will be apparent to those skilled in the art from the following disclosure and the description of preferred embodiments of the present invention.

The present invention relates to an improvement to a regenerative pump which comprises a housing, an impeller, and a pump chamber housing the impeller. The impeller is allowed to freely rotate inside the housing by means of a shaft. This impeller includes a flat disc-shaped base plate whose both flat side surfaces being rotated within a plane perpendicular to the rotating axis of the shaft, a plurality of concave channels formed along the peripheral edges on both side surfaces of the base plate, and blades positioned between these concave channels in a substantially radial direction of the base plate. The pump chamber is formed in the housing. The pump chamber includes inner plane side wall opposite to both flat side surfaces of the base plate of the impeller, a cylindrical inner peripheral wall opposite to the tip ends of the blades, and arcing grooved wall surfaces opposite to the side surfaces of the blades 4 for connecting the inner plane side wall to the cylindrical inner peripheral wall as well as forming a fluid passage connecting an inlet port to an outlet port, both being formed in the housing.

According to the present invention, a surface of each blade of said impeller facing forward in the direction of rotation of the impeller is formed in a concave and configuration of each blade in a plane perpendicular to the central axis of rotation of the impeller is formed such that center points of the thickness in the peripheral direction thereof in a radially outer portion of the blade are positioned at least in rear position in the direction of rotation of the impeller in relation to center points of the thickness in the peripheral direction thereof in a radially inner portion of the blade. Such a profile ensures the surface a length which affords a centrifugal force to a fluid flowing along said concave surface of each blade facing forward in the direction of the impeller as said impeller rotates. This makes it possible to increase a delivery pressure of the regenerative pump.

Moreover, according to the present invention, said center points of the thickness in the peripheral direction thereof in a radially outer portion of the blade are positioned in a row on one radial line of said base plate which passes through the central axis of rotation of said impeller. This configuration of the blade causes the radial flow of the fluid flowing along the concave surface of the blade facing forward in the direction of rotation of the impeller to merge with a fluid flowing through the fluid passage in the pump chamber substantially perpendicularly. This makes it possible to increase the delivery pressure of the pump to a much greater extent.

Further, according to the present invention, the configuration of each of blades in the plane perpendicular to the central axis of rotation of the impeller is formed such that the center points of thickness in the peripheral direction of said configuration are positioned in rear positions in the direction of rotation of the impeller according as the increase of measured radius of said center points. This configuration of the blade permits the selection of the magnitude of a centrifugal force acting on the fluid flowing along the concave surface of the blade facing forward in the direction of rotation of the impeller and the angle at which that fluid merges with the fluid flowing through the fluid passage. As a result of this, it is possible to obtain a delivery pressure in accordance with the applications for various purposes of the regenerative pump.

BRIEF DESCRIPTION OF THE DRAWINGS

Various other objects, features and attendant advantages of the present invention will more fully appreciated as the same becomes better understood from the following detailed description when considered in connection with the accompanying drawings in which like reference characters designate like or corresponding parts through the several views and wherein.

DESCRIPTION OF THE PREFERRED EMBODIMENTS

Figure 3:
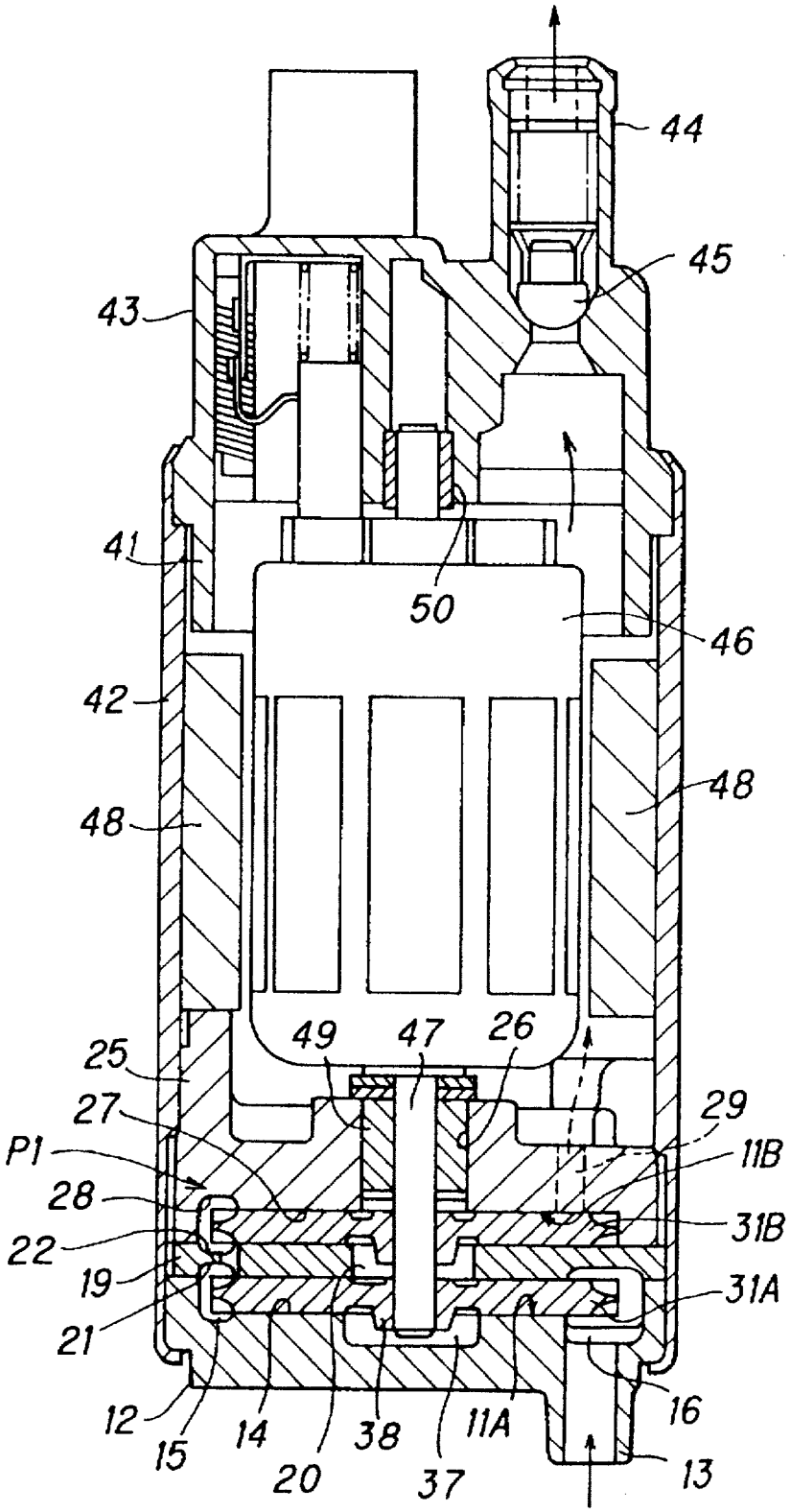
FIG. 3 is a longitudinal cros-sectional view of a fuel pump in which the regenerative pump in one embodiment of the present invention is used.
Figure 4:
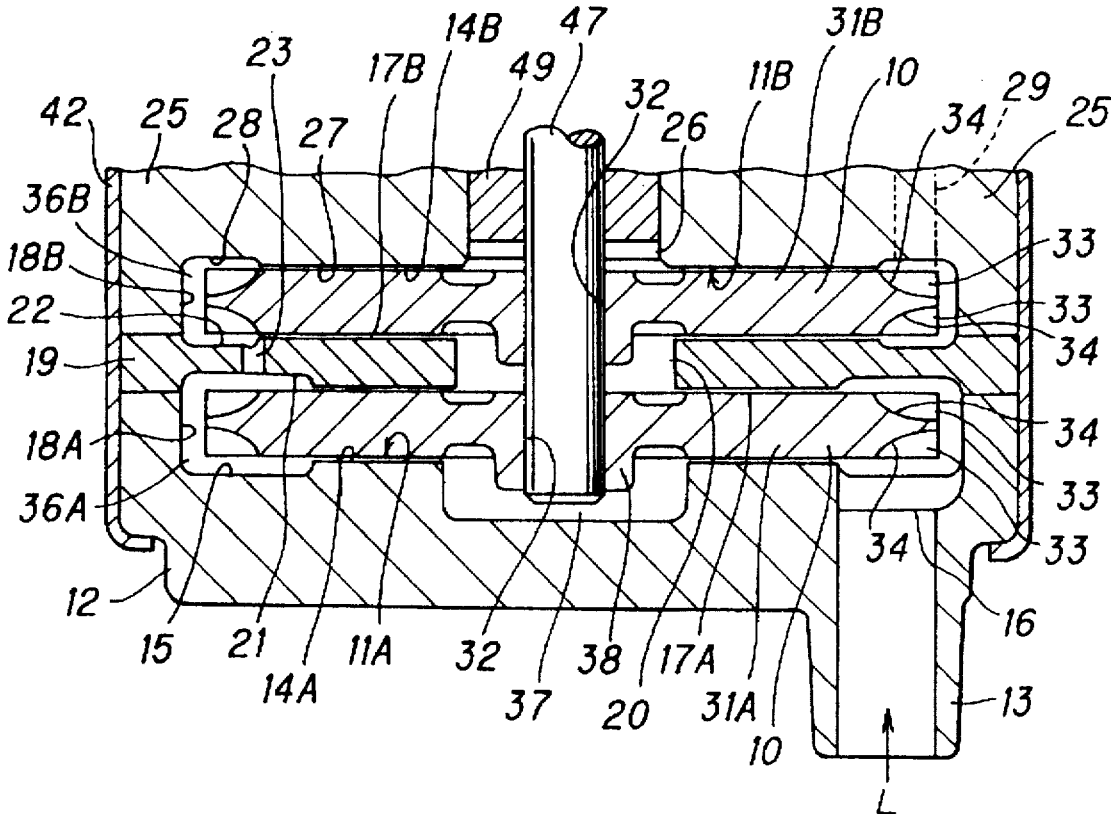
FIG. 4 is an enlarged cross-sectional view of the regenerative pump in the embodiment shown in FIG. 3.

FIGS. 3 and 4 show a fuel pump for use in an automobile engine in which a regenerative pump in one embodiment of the present invention is used. A cover 42 houses a pump P1 of the present invention and a motor 41, thereby constituting the fuel pump. The pump P1 is provided with first and second impellers 31A and 31B in this embodiment. The first impeller 31A is provided inside a first pump chamber 11A which is made up of an outer body 12 and a partition plate 19, and the second impeller 31B is provided inside a second pump chamber 11B which is made up of the partition plate 19 and an inner body 25. These first and second impellers 31A, 31B are simultaneously driven to rotate by a drive shaft 47 of the motor 41. That is, this pump is a two-stage pump.

Figure 5:
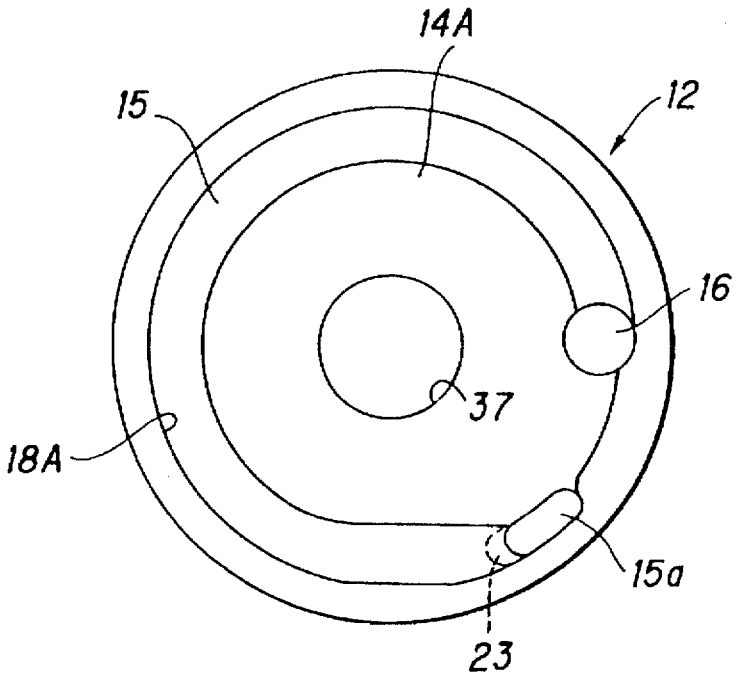
FIG. 5 is a plan view of an outer body of the regenerative pump.

The impellers 31A and 31B have the same construction and are respectively provided with flat disc-shaped base plate 10, a plurality of concave channels 34 formed along the peripheral edges on both sides of said base plate 10, blades 33 positioned between the concave channels 34 in substantially radial direction of the base plate 10 at even intervals. Both impellers 31A and 31B are supported by the drive shaft 47 of the motor 41 in such a way that the flat side surfaces of the base plate 10 rotate in the plane perpendicular to the central axis of rotation of the drive shaft 47. An inlet pipe 13 is integrally formed in the exterior surface of the outer body 12 of the pump P1. An inner plane side wall 14A is formed in the surface of the outer body 12 which faces to the first pump chamber 11A, and so the inner plane side wall 14A is opposite to the flat side surface of the base plate 10 of the first impeller 31A. A cylindrical inner peripheral wall 18A is also formed in the surface of the outer body 12 which faces to the first pump chamber 11A, and so the cylindrical inner peripheral wall 18A is opposite to the tip ends of the blades 33 of the first impeller 31A. A grooved wall surface 15 is formed around about 5/6 of the circumferential length of the first pump chamber 11A into an arcing shape as shown in FIG. 5. The grooved wall surface 15 connects the inner plane side wall 14A to the inner peripheral wall 18A at the position where the grooved wall surface is opposite to the side surfaces of the blade 33, as well as connecting an inlet port 16 comunicating with an inner passage of the inlet pipe 13 to the part of the surface of the outer body 12 opposite to an inlet-outlet port 23, which is formed throughout the thickness of the partition plate 19. This inlet-outlet port 23 will be described later. A recess **15*a* (FIG. 5) for muffling purposes is formed at the end of the grooved wall surface 15 communicating with the inlet-outlet port 23** by creating a step.

Reference numeral 37 designates a recess formed at the center of the inner plane side wall 14A of the outer body 12 for receiving the tip end of the drive shaft 47.

Figure 6:
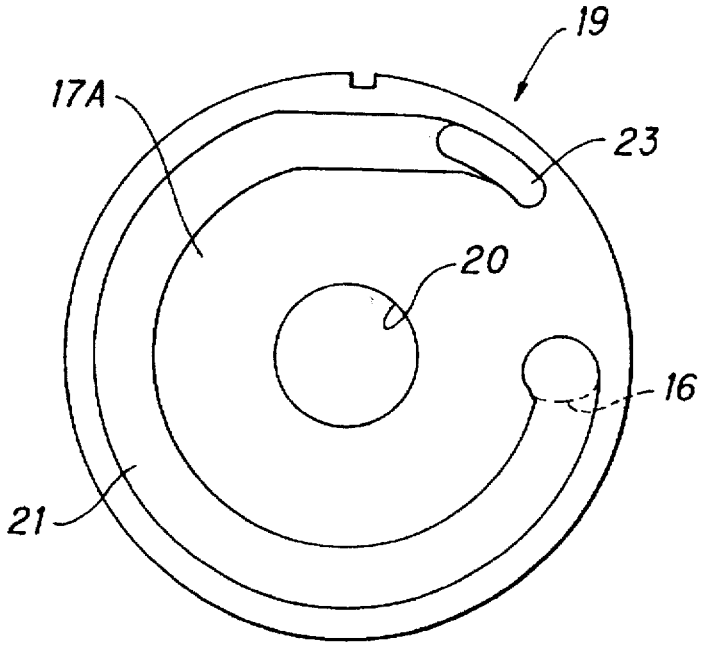
FIG. 6 is a bottom view of a partition plate in the regenerative pump.

The partition plate 19 is a flat plate having a circular contour, and a through hole 20 is formed at the center of the partition plate 19 so that the drive shaft 47 of the motor 41 can loosely pass through this hole 20. The inlet-outlet port 23 is formed to penetrate the partition plate 19 at the position spaced about 5/6 of the circumferential length of the first pump chamber 11A apart from the part of the partition plate 19 corresponding to the inlet port 16 formed in the outer body 12. An inner plane side wall 17A is formed in the part of the partition plate 19 which faces to the first pump chamber 11A in such a way as to be opposite to the flat side surface of the base plate 10 of the first impeller 31A. Moreover, as shown in FIG. 6, a grooved wall surface 21 is formed into an arcing shape around substantially 5/6 of the circumferential length of the first pump chamber 11A so as to connect the inlet-outlet port 23 to the part of the partition plate 19 corresponding to the inlet port 16. The grooved wall surface 21 connects the inner plane side wall 17A to the inner peripheral wall 18A formed on the outer body 12. As a result of this, a first fluid passage 36A which links the inlet port 16 to the inlet-outlet port 23 is circumferentially formed around about 5/6 of the peripheral length of the pump chamber 11A within the first pump chamber 11A, by the combination of the grooved wall surface 15 formed in the outer body 12 with the grooved wall surface 21 formed in the partition plate 19. The blades 33 of the first impeller 31A are exposedly positioned within this fluid passage 36A.

Figure 8:
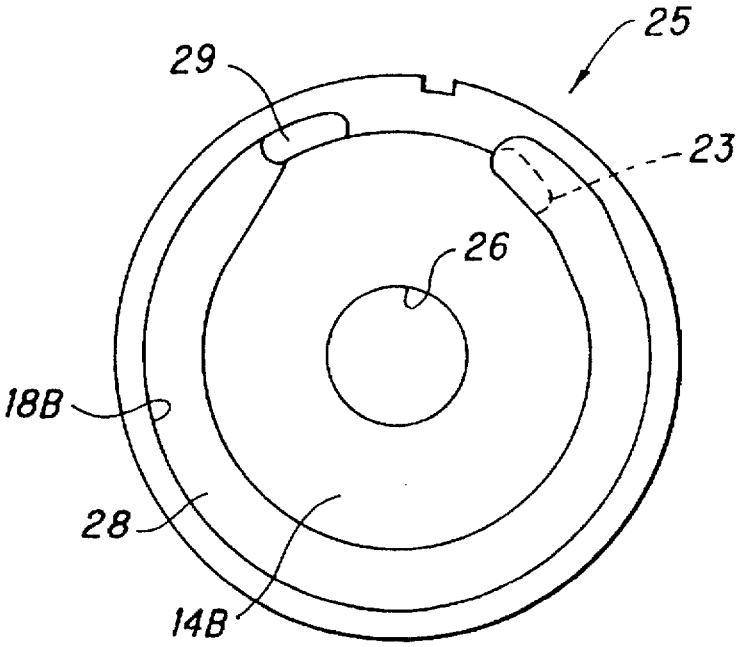
FIG. 8 is a bottom view of an inner body of the regenerative pump.

A through hole 26 is formed at the center of an inner body 25 of the pump P1 so that the drive shaft 47 of the motor 41 can loosely pass through the hole 26. An outlet port 29 is formed to penetrate the inner body 25, thereby establishing a communication between the second pump chamber 11B and the internal space of the cover 42. The outlet port 29 is circumferentially spaced apart around substantially 5/6 of the peripheral length of the second pump chamber 11B from the part of the inner body 25 opposite to the inlet-outlet port 23 formed in the partition plate 19. An inner plane side wall 14B is formed on the surface of the inner body 25 which faces to the second pump chamber 11B, in such a way as to be opposite to the flat side surface of the base plate 10. Moreover, a cylindrical inner peripheral wall 18B opposite to the tip ends of the blades 83 of the impeller 31B is formed on the surface of the inner body 25 which faces to the second pump chamber 11B. As shown in FIG. 8, a grooved wall surface 28 is formed into an arcing shape around 5/6 of the peripheral length of the second pump chamber 11B at the position where the grooved wall surface 28 is opposite to the flat side surfaces of the blades 33. This grooved wall surface 28 connects the inner plane side wall 14B to the inner peripheral wall 18B, as well as linking the outlet port 29 to the part of the inner body 25 opposite to the inlet-outlet port 28.

Figure 7:
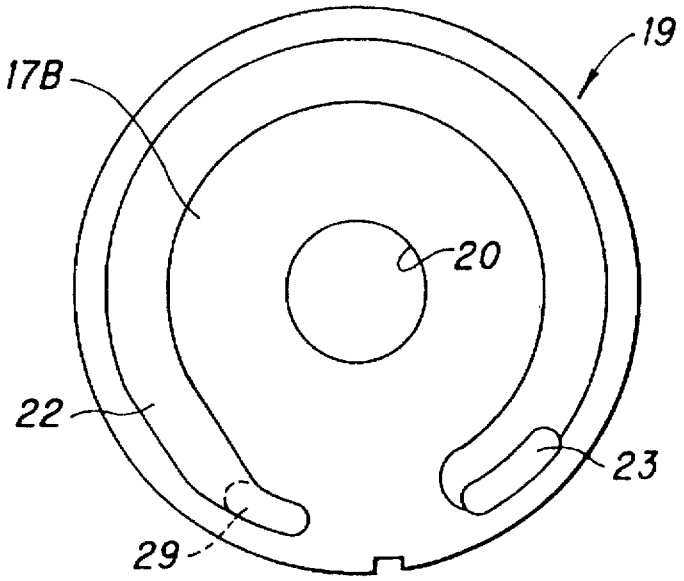
FIG. 7 is a plan view of the partition plate shown in FIG. 6.

An inner plane side wall 17B opposite to the flat side surface of the base plate 10 of the second impeller 31B is formed on the surface of the partition plate 19 which faces to the second pump chamber 11B. Further, as shown in FIG. 7, a grooved wall surface 22 is formed into an arcing shape around substantially 5/6 of the peripheral length of the second pump chamber 11B from the inlet-outlet port 23 to the part of the partition plate 19 opposite to the outlet port 29. This grooved wall surface 22 connects the inner plane side wall 17B with the inner peripheral wall 18B of the inner body 25. As a result of this, a second fluid passage 36B is circumferentially formed around substantially 5/6 of the peripheral length of the second pump chamber 11B within the second pump chamber 11B, by the combination of the grooved wall surface 28 formed in the inner body 25 and the grooved wall surface 22 formed in the partition plate 19, thereby establishing a communication between the inlet-outlet port 23 and the outlet port 29. The blades 33 of the second impeller 31A are exposedly positioned within this fluid passage 36B.

Figure 9:
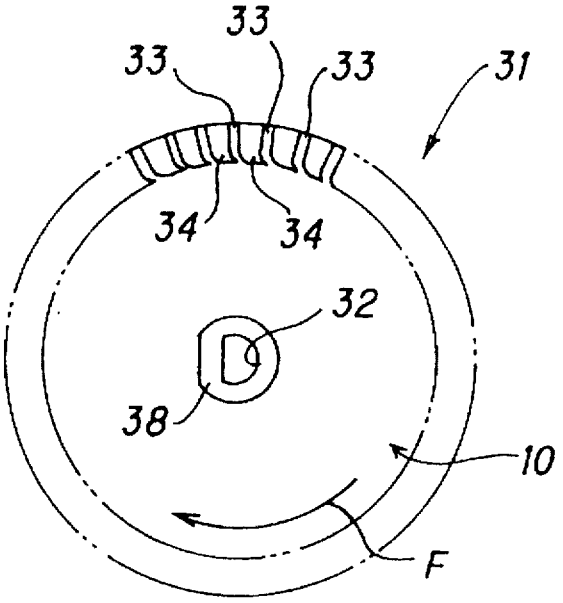
FIG. 9 is a plan view of an impeller in the regenerative pump.

FIG. 9 is a plan view of the impeller of the present invention. Since the first impeller 31A and the second impeller 31B have the same construction, the impeller shown in the drawing is designated by reference numeral 31.

The impeller 31 is made up of the flat disc-shaped base plate 10, and the plurality of concave channels 34 are formed at even intervals along the peripheral edges on both sides of the base plate 10 in such a way that the concave channels 34 become gradually deeper according as the increase of radius thereof. The blades 33 having a constant thickness in the peripheral direction are positioned between the concave channels 34. A protuberance 38 is formed at the center on one surface side of the base plate 10, and a shaft hole 32 having a D-shaped cross section is formed at the center of rotation of the base plate 10. The D-shaped cross section of the shaft hole 32 is made up of the combination of a semi-cylindrical inner wall having a central axis on the central axis of rotation of the base plate 10 with a longitudinal plane inner wall. The impeller 31 is fitted to the drive shaft 47 of the motor 41 through this shaft hole 32. The surface of the base plate 10 existed between the concave channels 34 and the protuberance 38 is plane.

Figure 10:
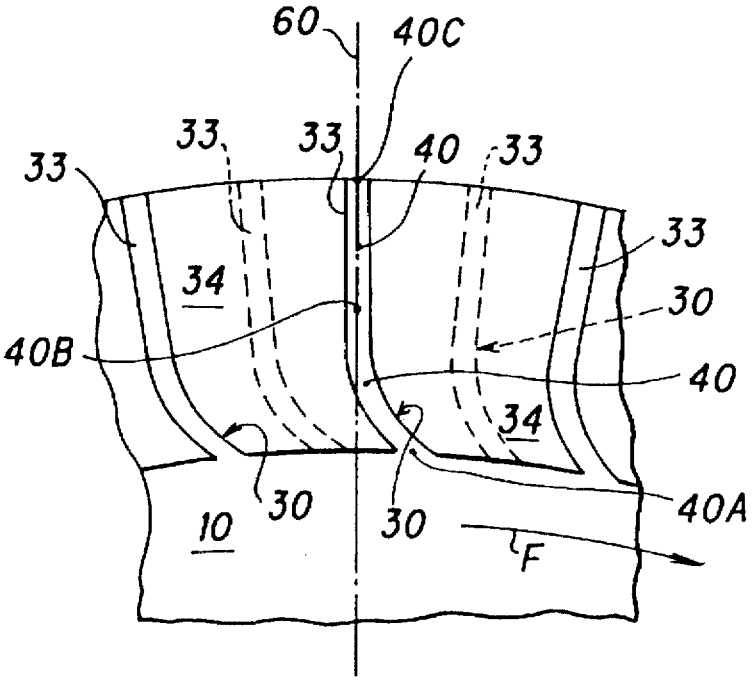
FIG. 10 is a partially enlarged plan view of the peripheral edge of the impeller in the regenerative pump.

The characteristic of the present invention is shown in FIG. 10 which is a partially enlarged view of the peripheral edge of the impeller 31. Specifically, a surface 30 of the blade 33 facing forward in the direction of rotation of the impeller 31 (designated by arrow F) is formed to be concave as viewed in a plane perpendicular to the central axis of rotation of the impeller. Moreover, the configuration of each of blades 33 in the aforementioned plane is formed such that center points 40 of thickness in the peripheral direction thereof in a radially outer portion of the blade 33 are positioned at least in rear positions in the direction of rotation F of the impeller 31 in relation to center points 40 of thickness in the peripheral direction thereof in a radially inner portion of the blades 33.

It is assumed that within a plurarity of center points 40, reference numeral 40A designates the center point 40 located at the inner most end of the blade 33 where the minimum length of radius is measured, reference numeral 40C designates the center point 40 located at the outermost end of the blade 33 where the maximum length of radius is measured and reference numeral 40B designates the center point 40 located substantially central portion of the longitudinal length of the blade 33. It is preferable in the present invention that in a plane perpendicular to the central axis of rotation of the impeller 31, a line connecting the center points 40 located between center points 40A and 40C in the region where smaller radius are measured is an arc line of which concave face faces forward in the direction designated by arrow F, and a line connecting center points 40 located between 40C and 40B in the region where larger radius are measured is a straight line which is coinceded with one radial line 60 of the base plate 10 passing through said center point 40B and central axis of rotation of the impeller 31, as shown in FIG. 10. In FIG. 10, the blades 33 indicated by a dotted line represent the blades formed on the rear surface side of the base plate 10, and the blades on the rear surface side are circumferentially shifted relative to the blades 33 on the front surface side shown by a solid line, so that they are staggered in relation to one another.

Figure 11:
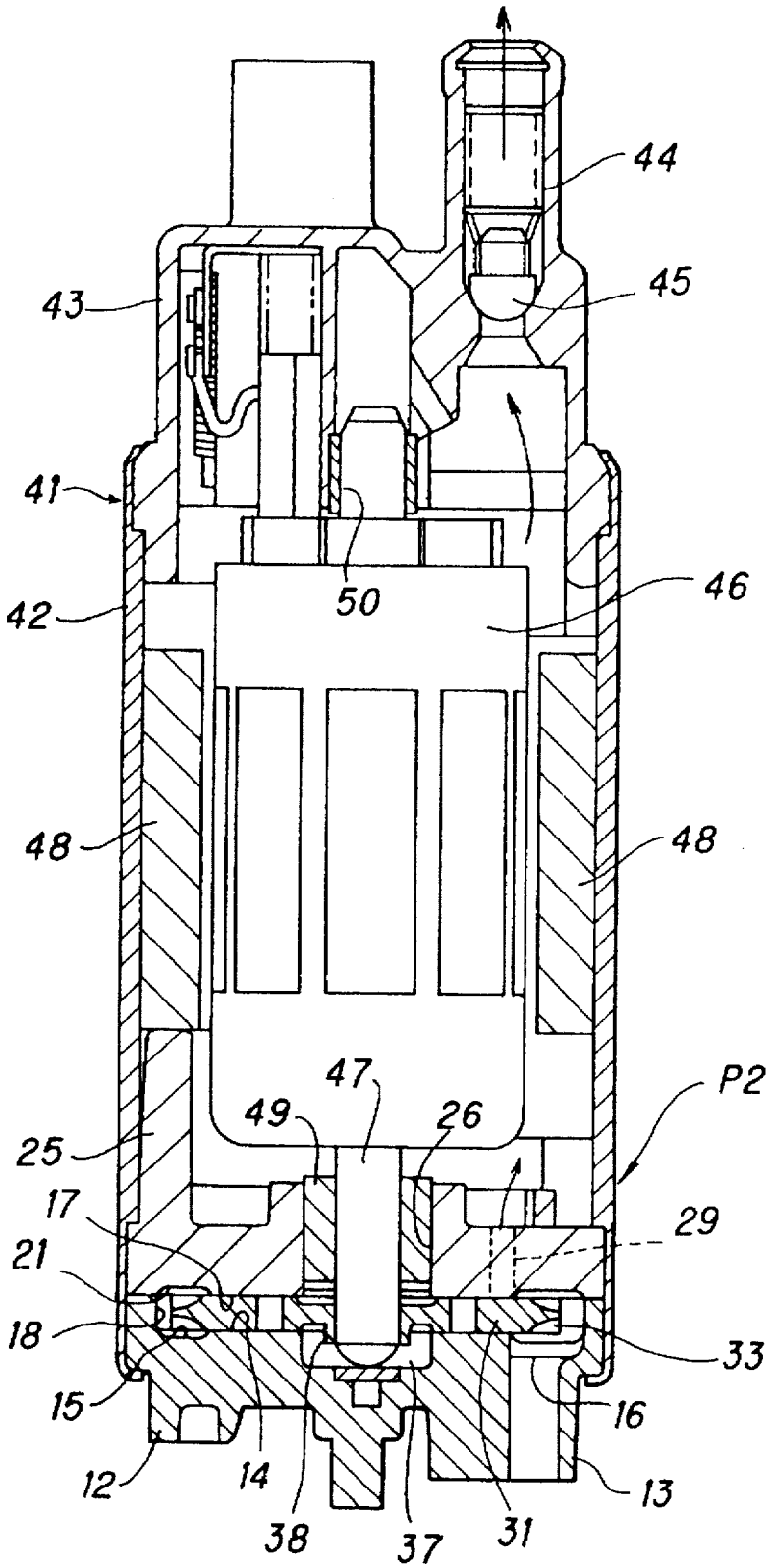
FIG. 11 is a longitudinal cross-sectional view of a fuel pump in which the regenerative pump in another embodiment of the present invention is used.
Figure 12:
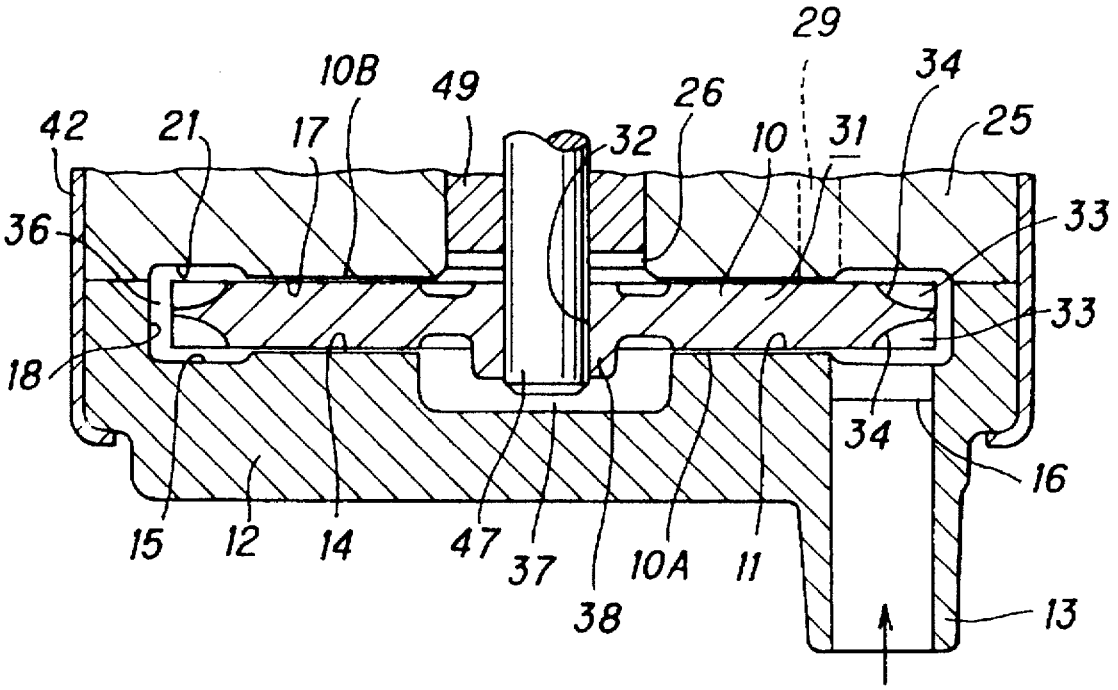
FIG. 12 is an enlarged cross-sectional view of the regenerative pump in the embodiment shown in FIG. 11.

In the fuel pump shown in FIG. 3, the motor 41 for driving the pump P1 is positioned within the cover 42. A rotor 46 of the motor 41 is supported, at one end of the drive shaft 47, by the inner body 25 through a bearing 49 and, at the other end of the drive shaft 47, by an end member 43 through a bearing 50. This end member 43 closes the end of the cover 42. Commutators, brushes, choke coils, or the like, used in the motor 41 are left out of FIG. 3. When the motor 41 is driven, the first impeller 31A and the second impeller 31B rotate together with the drive shaft 47, fuel introduced from the inlet pipe 13 is delivered to the internal space of the cover 42 through the outlet port 29 of the inner body 25 via the fluid passage 36A of the first pump chamber 11A and the fluid passage 36B of the second pump chamber 11B. The fuel delivered to the internal space of the cover 42 flows around the rotor 46 of the motor 41, and then the fuel is discharged from an outlet port 44 via a check valve 45 disposed in the end member FIGS. 11 and 12 show an automobile fuel pump which uses a regenerative pump in another embodiment of the present invention. The construction of the fuel pump shown in FIG. 11 is identical with that shown in FIG. 3 except that a pump P2 in another embodiment of the present invention is used instead of the pump P1. The same reference numerals are provided to designate the identical or corresponding features shown in FIG. 3, and hence the explanation thereof will be omitted here for brevity.

The pump P2 in this embodiment includes one impeller 31 housed in one pump chamber 11 formed between the inner body 25 and the outer body 12. The impeller 31 is the same as the first and second impellers 31A and 31B, and the outer body 12 has the same structure as that shown in FIGS. 4 and 5. Namely, the inlet pipe 13 is formed in the outer surface of the outer body 12; the inner surface of the outer body 12 facing to the pump chamber 11 comprises an inner plane side wall 14 opposite to the flat side surface 10A of the base plate 10 of the impeller 31, a cylindrical inner peripheral wall 18 opposite to the tip ends of the blade 33, and an arcing grooved wall surface 15 which connects the inner plane side wall 14 to the inner peripheral wall 18; and the inlet port 16 is formed in the grooved wall surface 15. As identical with the construction of the partition plate 19 shown in FIGS. 4 and 6, the surface of the inner body 25 facing to the pump chamber 11 comprises an inner plane side wall 17 opposite to the flat side surface 10B of the base plate 10, and an arcing grooved wall surface 21 which connects the inner plane side wall 17 with the iner peripheral wall 18. An outlet port 29 is formed at the part of the inner body 25 which corresponds to the inlet-outlet port 23 which was formed in the partition plate 19. As a result of this, a fluid passage 36 which connects the inlet port 16 with the outlet port 29 is circumferentially formed around substantially ⅚ of the peripheral length of the pump chamber 11 within the pump chamber 11, by the combination of the grooved wall surface 15 formed in the outer body 12 with the grooved wall surface 21 formed in the inner body 25. The blades 33 of the impeller 31 are exposedly positioned within this fluid passage 36.

Figure 1:
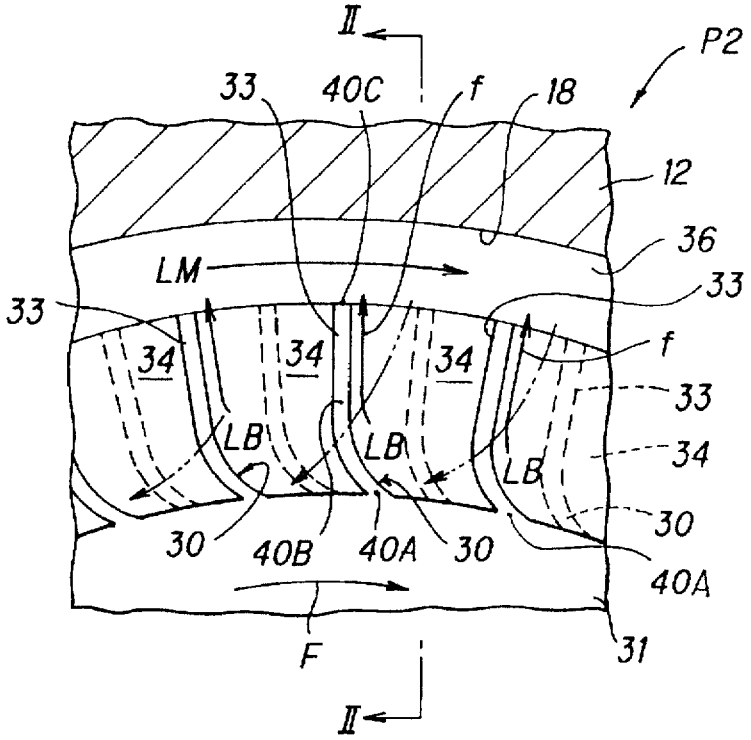
FIG. 1 is a schematic sectional view showing the principal elements of a regenerative pump according to the present invention.
Figure 2:
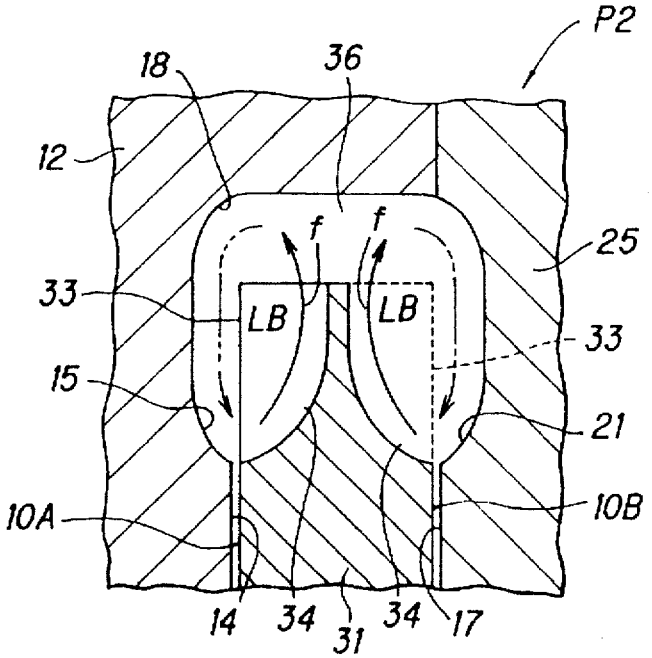
FIG. 2 is a cross-sectional view taken along line II—II in FIG. 1.

With reference to the regenerative pump in one embodiment of the present invention schematically shown in FIGS. 1 and 2, the operation of the pump will now be described. The same reference nemerals are used to designate the corresponding features of the one-stage pump P2 shown in FIGS. 11 and 12.

When the impeller 33 is rotated in the direction designated by arrow F, the movement of the blades 33 positioned within the fluid passage 36 generates liquid flow LM in the direction identical with the arrow F within the fluid passage 36 made by the combination of two grooved wall surfaces 15 and 21. Clearances between the inner plane side wall 17 of the outer body 12 and the flat side surface 10B of the base plate 10, and between the inner plane side wall 14 of the inner body 25 and the flat side surface 10A of the base plate 10 (see FIG. 2) are set to the minimum dimension so as to prevent the base plate 10 from coming into contact with either the outer body 12 or the inner body 25 as well as to prevent the fluid therein from flowing in the radial direction of the impeller 31.

In the vicinity of the peripheral edge of the impeller 31, a centrifugal force resulting from the rotation of the impeller 31 is afforded to the fluid in contact with the surface 30 of the blade 33 which faces forward in the direction of rotation of the impeller 31 designated by the arrow F, as the impeller 31 rotates. This results in radial liquid flow LB designated by arrow f developing within the concave channels 34.

In a plane perpendicular to the central axis of rotation of the impeller 31 (see FIG. 1), center points 40 of thickness in the peripheral direction within the range in a radially outer portion of the blade where larger radius are measured (a range between the center point 40B and the center point 40C) are positioned at least in rear positions in the direction F of rotation of the impeller 31 in relation to center points 40 of thickness in the peripheral direction within the range in a radially inner portion of the blade where smaller radius are measured (a range between the center point 40B and the center point 40A). Therefore, the length of the surface 30 between the outmost end of the blade 33 and the innermost end of the blade 33, that is the length corresponding to center point 40C and the center point 40A, is longer than the length of the surface 9 of the conventional impeller 31 shown in FIG. 16. On the assumption that the rotational speeds of the impellers 31 and 3 are the same, a centrifugal force developed for generating the radial liquid flow LB by the impeller 31 of the present invention will be greater than the centrifugal force developed for generating the radial liquid flow LB by the conventional impeller 3.

Figure 16:
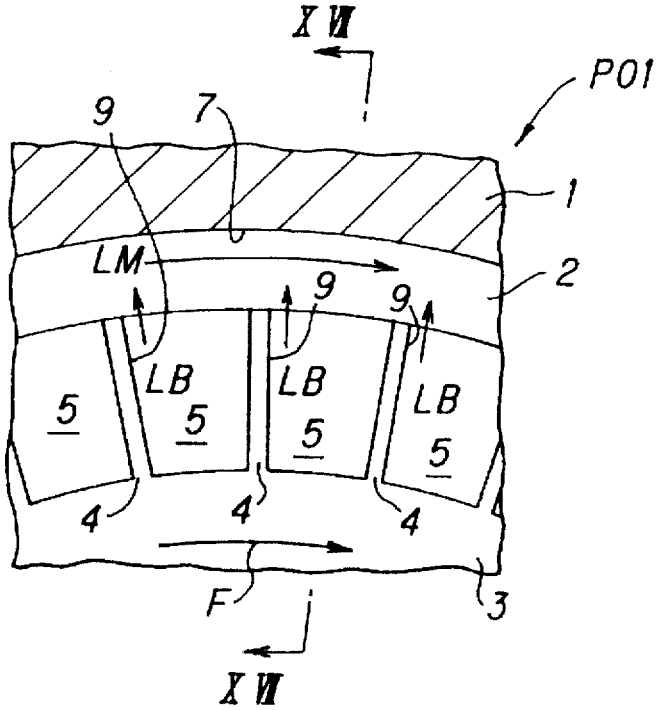
FIG. 16 PRIOR ART
FIG. 16 is an enlarged cross-sectional view of the principal elements of a conventional common regenerative pump.

In the present invention, assume that the thickness of the blade 33 in the peripheral direction is constant from the innermost end of the blade 33 (the position corresponding to the center point 40A) to the tip end of the same (the position corresponding to the center point 40C), the volume of the concave channel 34 formed between the blades 33 will be the same as the volume of the concave channel 5 formed in the conventional impeller 3 shown in FIG. 16 having blades whose thickness in the peripheral direction is the same as that of the blade 33.

For this reason, the regenerative pumps (P1 and P2) in accordance with the present invention can increase the delivery pressure without decreasing the flow rate when compared with the conventional regenerative pump (P01).

The pump efficiency [η(%)] is given by the follwing formula (1).

$$\eta(\%)=\kappa\cdot P\cdot Q/N\cdot T \quad (1)$$

In the formula (1), K is a correction coefficient, P is a delivery pressure (κPa), Q is a delivery flow rate (l/h), N is a rotational speed (rpm), and T is a load torque (N·m). In the pump P1 shown in FIGS. 3 and 4, κ was 0.265 and T was 0.034N·m.

From the formula (1), if the rotational speed N and the load torque T are respectively constant, it will be understood that the pump efficiency η is proportional to a value (P·Q) obtained by multiplying the delivery pressure P by the delivery flow rate Q. When the delivery pressure is increased without decreasing the delivery quantity, the pump efficiency will be improved.

Figure 17:
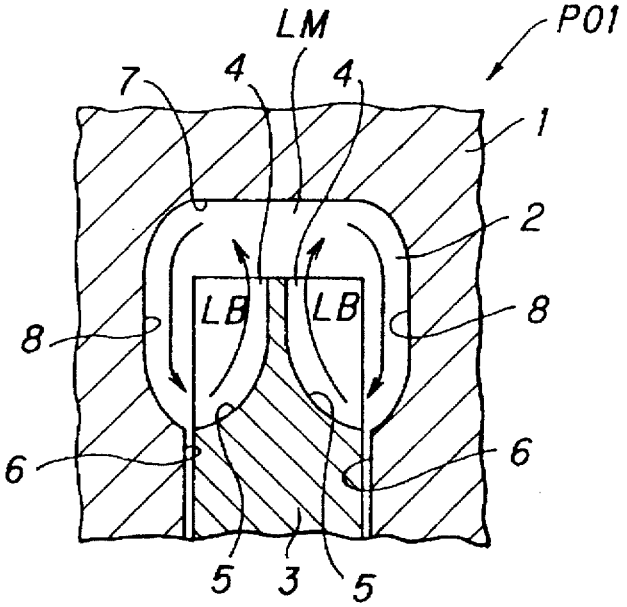
FIG. 17 PRIOR ART
FIG. 17 is a cross-sectional view taken along line XVII—XVII shown in FIG. 16.
Figure 18:
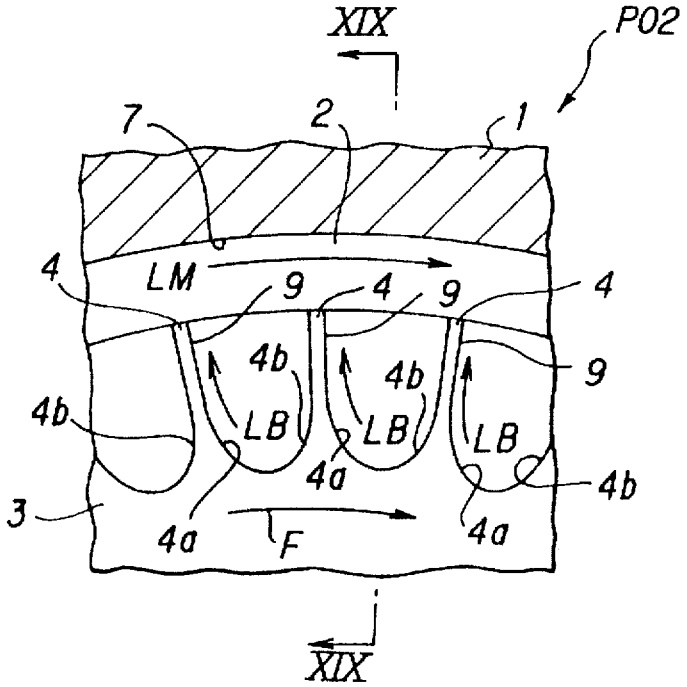
FIG. 18 PRIOR ART
FIG. 18 is an enlarged cross-sectional view of a publicly known improved regenerative pump.
Figure 19:
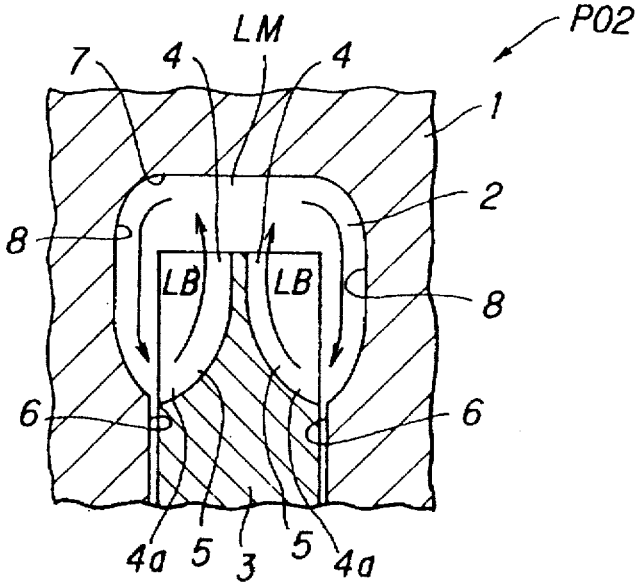
FIG. 19 PRIOR ART
FIG. 19 is a cross-sectional view taken along line XIX—XIX shown in FIG. 18.

Table 1 shows test data obtained as a result of a comparison between the pump P1 of the present invention, the conventional pump P01 shown in FIGS. 16, and 17 and the conventional improved pump P02 shown in FIGS. 18 and 19.

The impeller 3 of the comparative pumps P01 and P02 used in the test, and the impeller 31 of the pump P1 of the present invention were arranged in the form of a two-stage type as shown in FIGS. 3 and 4. Moreover, the impellers 3 and 31 of the pumps P01, P02 and P1 are the same in size and have the same shape for the pump chamber. However, the blades 4 and 33 formed in the impellers 3 and 31 are of respective different shapes as shown in FIGS. 16, 18 and 1.

TABLE 1

| | PUMP | P01 | P02 | P1 |
|---|---|---|---|---|
| PRESET VALUES | VOLTAGE (V) | 12 | 12 | 12 |
| | DELIVERY PRESSURE (P) (κPa) | 284 | 284 | 284 |
| MEASURED VALUES | ROTATIONAL SPEED (N) (rpm) | 5200 | 5050 | 5000 |
| | DELIVERY FLOW RATE (Q) (l/h) | 61.1 | 59.5 | 63.3 |
| | VOLUME OF ONE CONCAVE CHANNEL ($mm^3$) | 4.6 | 4.4 | 4.6 |
| | PUMP EFFICIENCY (η) (%) | 26.0 | 26.1 | 28.0 |

The above comparison test was carried out by setting the delivery pressure P of each of the pumps P01, P02 and P1 to a predetermined value 284 (κPm). The delivery flow rate Q(l/h) of the pump P1 in accordance with the present invention was 63.3, and the delivery flow rates of the pumps P01 and P02 were 61.1 and 59.5, respectively. Thus, the pump P1 has a greater delivery flow rate Q compared with the pumps P01 and P02. As to the pump effiency η which is proportional to the value obtained as a result of the multiplication of the delivery flow rate by the delivery pressure, the pump P1 in accordance with the present invention is superior to the comparative pumps P01 and P02.

The pump in accordance with the present invention is compared with the comparative pumps with respect to the delivery pressure (P)—delivery flow rate (Q) characteristic and the rotational speed (N)—delivery flow rate (Q) characteristic.

FIGS. 13A through 13E respectively show the configuration in cross section of the blades formed in the blades of the pumps used for comparision. Each drawing diagrammatically shows the configuration of each blade taken along a plane perpendicular to the central axis of rotation of the impeller.

Each blade used in the comparision test has an identical thickness (t) in the peripheral direction and an identical radial length, that is, a difference in radial distance between the tip end of the blade (the position corresponding to the center point 40C) and the innermost end of the blade (the position corresponding to the center point 40A), in the plane perpendicular to the central axis of rotation of the impeller, respectively.

Figure 13A:
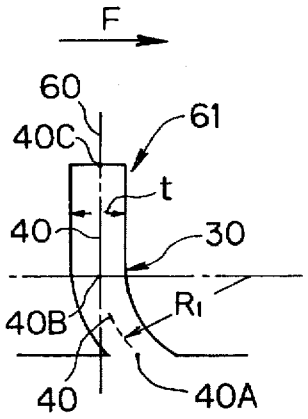
FIG. 13A through 13E are representations diagrammatically showing, respectively, the cross-section of blade of the impeller of the regenerative pump according to the present invention together with the cross-section of a blade of an impeller of a comparative regenerative pump, respectively.

Blades 61 shown in FIG. 13A correspond to the blades 33 of the pump P1 in the embodiment of the present invention. In the region where the measured radius is larger, the region corresponding from the tip end (the position corresponding to the center point 40C) of the blade 61 and the central portion (the position corresponding to the center point 40B) of the blade 61, the line connecting the center points 40 (40C–40B) is made as a straight line coinceded with one radial line 60 connecting the central axis of rotation with the center point 40C. However, in the region where the measured radius is smaller, the region corresponding from the innermost end of the blade 61 (the position corresponding to the center point 40A) to the central portion of the blade 61 (the position corresponding to the center point 40B), a line connecting the center points 40 (40B–40A) of the blade 61 is made as an arc shape circumscribing with the radial line 60. As a result of this, the surface 30 facing forward in the direction of the rotation of the impeller assumes a circular arc shape defined by a radius $R_1$ ($R_1$=3t) in the range from the innermost end to the central portion of the blade 61, as shown in FIG. 13A. On the contrary, the range between the central portion and the tip end (40B–40C) of the blade 61 becomes linear.

Figure 13B:
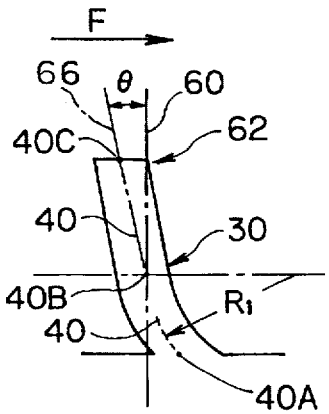

FIG. 13B shows a modified example 62 of the blade 61 shown in FIG. 13A. In the region between the central portion (the position corresponding to the center point 40B) and the tip end (the position corresponding to the center point 40C) of the blade 62, the line connecting the center points 40C and 40B is made as a straight line 66 which crosses the radial line 60 at an angle θ (about 5 degrees) with respect to the radial line 60.

Figure 13C:
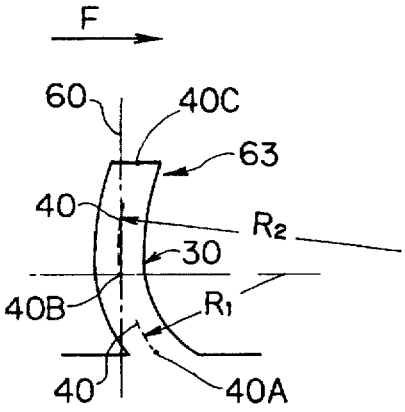
Figure 13D:
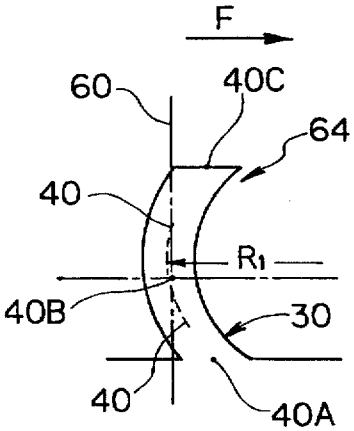

FIGS. 13C and 13D respectively show blades 63 and 64 of the comparative pumps. For each of these blades 63 and 64 the center points 40A of thickness at the base portion and the center point 40C of thickness at the tip end of the blade are positioned in front of the center point 40B of thickness at the longitudinal central portion of the blade with respect to the rotating direction F in the plane perpendicular to the central axis of rotation of the impeller. The contour of the surface 30 which faces forward in the direction F of rotation of the impeller becomes in part a circular arc defined by the radius $R_1$ ($R_1$=3t) in a region where smaller radius are measured, but becomes in another part a circular arc defined by a radius $R_2$ ($R_2$=6t) in a region where larger radius are measured. The contour of the surface 30 of the blade 64 shown in FIG. 13D becomes a circular arc defined by the radius $R_1$ ($R_1$=3t) in the overall region of the surface.

Figure 13E:
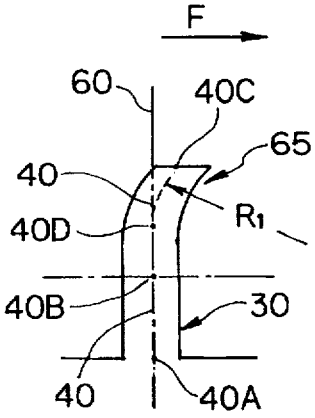

FIG. 13E shows a blade 65 of another comparative pump. In the blade 65, the line connecting the center point 40D of the blade 65 located between the center points 40B and 40C, to the center point 40A is made as a line coinceded with the radial line 60, whilst the line connecting the center point 40D to the center point 40C at the tip end of the blade 65 is made as a circular arc. As a result of this, the contour of the front surface 30 of the blade 65 becomes in part a line parallel to the radial line 66 from the innermost end to the midpoint (the position corresponding to the center point 40D) of the blade, but the contour of the other part of the front surface 30 becomes a circular arc defined by the radius $R_1$ ($R_1$=3t).

Figure 14:
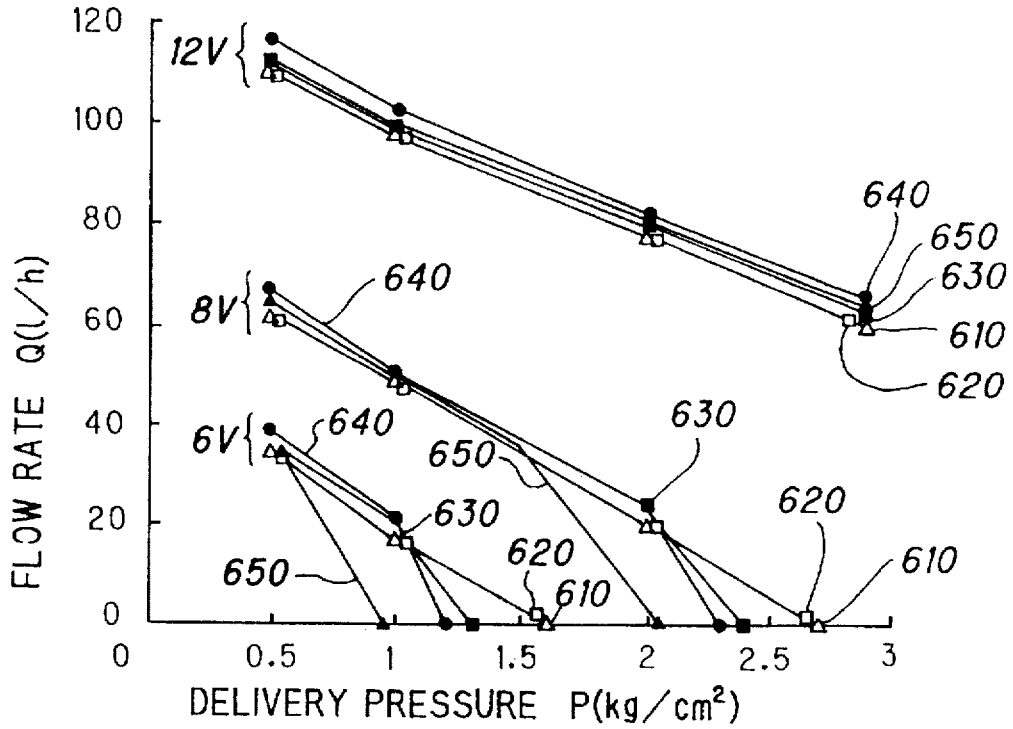
FIG. 14 is a graph showing the relationship between a delivery pressure and a flow rate respectively for the regenerative pump in accordance with the present invention and the comparative regenerative pumps.
Figure 15:
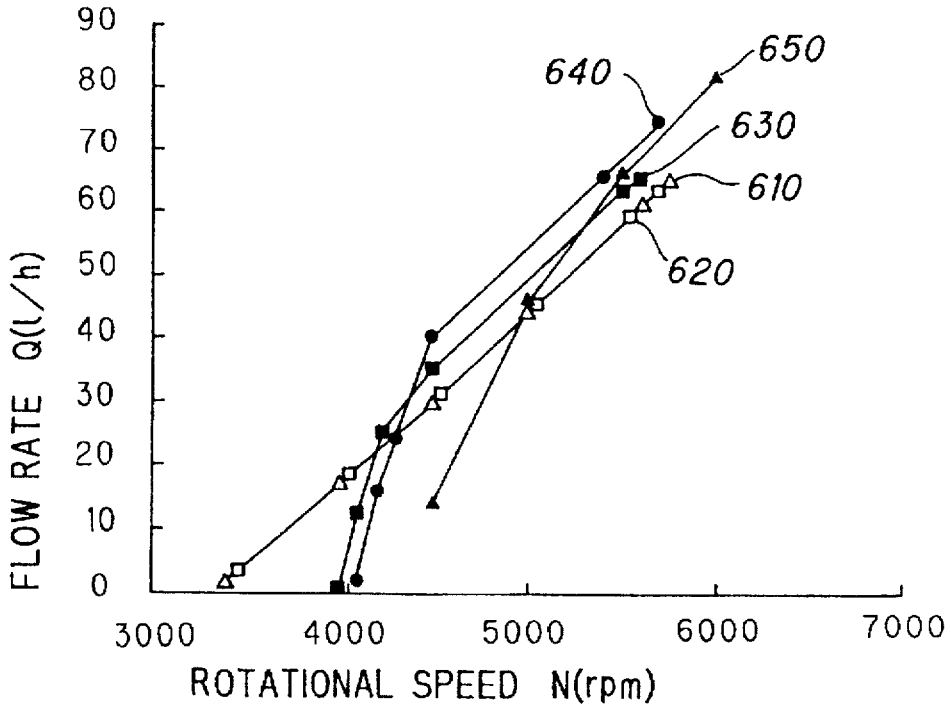
FIG. 15 is a graph showing the relationship between a rotational speed of an impeller and a flow rate respectively for the regenerative pump in accordance with the present invention and the coparative regenerative pumps.

FIGS. 14 and 15 show results of a comparision test. FIG. 14 is a P-Q characteristic graph showing the relationship between the delivery pressure P and the delivery flow rate Q of each of the pumps used in the test when voltages of the motors for driving the pumps were respectively set to 6 V, 8 V, and 12 V. The preset voltages represent the required minimum voltage for the motor at the starting of the pump, and 6 V represents the required voltage at low temperature, 8 V represents the required voltage at high temperature and 12 V represents the required voltage at normal temperature. FIG. 15 is an N-Q characteristic graph showing the relationship between the rotational speed N of the impeller and the delivery flow rate Q under the condition of a constant value (284 κPa) of the delivery pressure P. In these drawings, reference numerals 610, 620, 630, 640 and 650 are characteristic lines of pumps equipped with the impellers having the blades 61, 62, 63, 64 and 65 shown in FIGS. 13A–13E. As shown in these figures, the lines 610 and 620 are approximately the same.

As can be seen from these drawings, the pumps in the embodiment according to the present invention having the blades shown in FIGS. 13A and 13B are stable even when the driving of the pump is started in the low temperature or high temperature. Moreover, the according to the present invention provide a higher delivery pressure P compared with the comparative samples when the delivery flow rate Q is the same.

Further, as is evident from FIG. 15, the pumps in the embodiments of the present invention are stable even when the rotational speeds of the impellers are in a low range, and also provide a smaller delivery flow rate Q when compared with the comparative samples when the rotational speed N is the same.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention, without departing from the spirit and scope of the invention, be apparent to persons skilled in the art.

What is claimed is:

1. A regenerative pump comprising:

a housing;

an impeller rotatably mounted inside of the housing by means of a shaft, said impeller including a flat disc-shaped base plate whose both sides being rotated within a plane perpendicular to a central axis of rotation of said shaft, a plurality of concave channels formed along the peripheral edges on both sides of said base plate and blades positioned between these concave channels in a substantially radial direction of said base plate; and a pump chamber formed in the housing for accommodating said impeller, said pump chamber including inner plane side wall opposite to both flat side surfaces of said base plate of the impeller, a cylindrical inner peripheral wall opposite to the tip ends of said blades, and arcing grooved wall surfaces connecting said inner plane side wall to said cylindrical inner peripheral wall as well as forming a fluid passage connecting an inlet port to an outlet port, both being formed in said housing, the improvement being characterized in that a surface of each blade of said impeller facing forward in the direction of rotation of the impeller is formed in a concave, a configuration of each of said blades in a plane perpendicular to a central axis of rotation of the impeller is formed such that a first set of center points of thickness in a peripheral direction thereof located in a radially outer portion of the blades are positioned at least in rear positions in the direction of rotation of the impeller in relation to a second set of center points of thickness in the peripheral direction thereof located in a radially inner portion of the blade, and said first set of center points of thickness in the peripheral direction located in said radially outer portion of the blade are positioned in a row on a straight line which cross one radial line of the base plate at an angle greater than zero degrees and not greater than five degrees.

* * * * *

UNITED STATES PATENT AND TRADEMARK OFFICE

CERTIFICATE OF CORRECTION

PATENT NO. : 5,642,981

DATED : July 1, 1997

INVENTOR(S) : Eisuke Kato, et al.

It is certified that error appears in the above-indentified patent and that said Letters Patent is hereby corrected as shown below:

Item [63] Related U.S. Application Data:

Change "Continuation of Ser. No. 506,774, Jul. 26, 1996, abandoned", to --Continuation of Ser. No. 506,774, Jul. 26, 1995, abandoned--

Signed and Sealed this

Seventh Day of October, 1997

*Attest:*

Bruce Lehman

BRUCE LEHMAN

*Attesting Officer*

*Commissioner of Patents and Trademarks*